US007322442B2

(12) United States Patent
Clark et al.

(10) Patent No.: US 7,322,442 B2
(45) Date of Patent: Jan. 29, 2008

(54) LADDER TOP WALK THROUGH EXTENSIONS

(76) Inventors: Bruce D. Clark, 7455 Highway 12, Maple Plain, MN (US) 55359; Frederick G. Feik, 4964 County Road 19, Maple Plain, MN (US) 55359

( * ) Notice: Subject to any disclaimer, the term of this patent is extended or adjusted under 35 U.S.C. 154(b) by 322 days.

(21) Appl. No.: 11/042,741

(22) Filed: Jan. 25, 2005

(65) Prior Publication Data

US 2005/0236227 A1 Oct. 27, 2005

Related U.S. Application Data

(60) Provisional application No. 60/564,698, filed on Apr. 23, 2004, provisional application No. 60/605,606, filed on Aug. 30, 2004.

(51) Int. Cl.
*E06C 7/42* (2006.01)

(52) U.S. Cl. ..... 182/106

(58) Field of Classification Search ..... 182/106, 182/82, 107
See application file for complete search history.

(56) References Cited

U.S. PATENT DOCUMENTS

| | | | | |
|---|---|---|---|---|
| 3,136,384 | A * | 6/1964 | Sweeney et al. | 182/106 |
| 4,146,114 | A * | 3/1979 | Beavers | 182/206 |
| 4,293,055 | A | 10/1981 | Hooser | 182/106 |
| 4,548,293 | A | 10/1985 | Haab | 182/99 |
| 5,012,895 | A | 5/1991 | Santos | 182/204 |
| 5,242,031 | A | 9/1993 | Ashley | 182/214 |
| 5,282,339 | A * | 2/1994 | Devlin et al. | 52/20 |
| 5,341,899 | A | 8/1994 | Casamento | 182/205 |
| D364,930 | S | 12/1995 | Burge et al. | D25/68 |
| D402,046 | S | 12/1998 | Lal | D25/68 |
| 5,941,343 | A | 8/1999 | Kelsey | 182/107 |
| 6,095,283 | A | 8/2000 | Ellis | 182/82 |
| 6,394,229 | B1 * | 5/2002 | Hastreiter | 182/107 |
| 2005/0023084 | A1 * | 2/2005 | Lazarus | 182/214 |
| 2005/0211501 | A1 * | 9/2005 | Maiorano | 182/106 |

* cited by examiner

*Primary Examiner*—Alvin Chin-Shue
(74) *Attorney, Agent, or Firm*—Westman, Champlin & Kelly, P.A.

(57) ABSTRACT

Walk through ladder extensions are provided to attach to the upper ends of ladder side rails, and define a wide unobstructed space between them. The extensions can be gripped by a user to steady the user as the user moves onto a roof of a building against which the ladder is placed.

7 Claims, 10 Drawing Sheets

LADDER TOP WALK THROUGH EXTENSIONS

This application refers to and claims the benefit of priority from two U.S. Provisional Patent Applications, namely, Ser. No. 60/564,698, filed Apr. 23, 2004 and Ser. No. 60/605,606, filed Aug. 30, 2004 and both applications are hereby incorporated by reference.

BACKGROUND OF THE INVENTION

The present invention relates to hand grip or rail extensions that are placed onto the upper or top end of a ladder, and spaced apart sufficiently to permit a person or user to have hand grips above the upper end of the ladder, which can be used for support as a person or user walks between the hand grip or rail extensions onto a roof or other support structure. The extensions are fixed to the upper ends of the side rails of a ladder, and provide a pair of stable uprights of selected height. Suitable clamps, locks or attachment members can be utilized for securing the extensions to the ladder rails or to the rungs.

When ladders are placed against the edge of a roof of a building, for example, many times the ladder upper end will be right at the edge of the roof, and no user, hand grip or support is provided. Even if the ladder protrudes above the roof, there is difficulty in getting onto the roof because of the interference of the ladder rungs. This makes it so the user may have to go around or to the outside of the ladder and step onto the roof, which can be hazardous.

SUMMARY OF THE INVENTION

The present invention relates to a ladder walk through stabilizer extension assembly for an upper end of the ladder to provide a support for a person using a ladder as the person steps onto a roof or other surface at the top of the ladder. A pair of upwardly projecting extension rails or hand grips that are spaced apart can be used by a user moving from the ladder onto a roof or surface for a more stable support while doing so. There are no obstructions between the upright extension rails or supports, and thus, there is no interfering members that would form any obstructions when a person steps between the extensions. The upright extension rails extend above each of the side rails of the ladder. This means that the operator does not have to crawl on hands and knees or assume awkward positions to go around the side of the ladder, or move to clear rungs or other obstructions.

The extension rails can be any desired form, but preferably mount directly on or against the side rails of the ladder, and then are clamped or fixed securely in place. The extensions also can be attached to upper ladder rungs, or with hollow rung ladder, the connections can be long bolts that extend through the rungs.

The extension rails or supports are each preferably formed metal tubes that form an inverted U, so that one or both legs of the U, which extend upwardly from the ladder, can be gripped by a person. The upper end can be formed into a rounded, hand grip portion that is easily held as well. The extensions or rails preferably are made or formed so the "walk through" portions are spaced wider than the ladder rails to accommodate the user without interference as the person steps onto a support.

The extensions make it easy to get onto a roof in particular, and also get off of a roof, without having to climb over rungs, or awkwardly attempt to go around the side of a ladder, at the same time when the user has to go on to a roof slope.

DETAILED DESCRIPTION OF THE PREFERRED EMBODIMENTS

Figure 1:
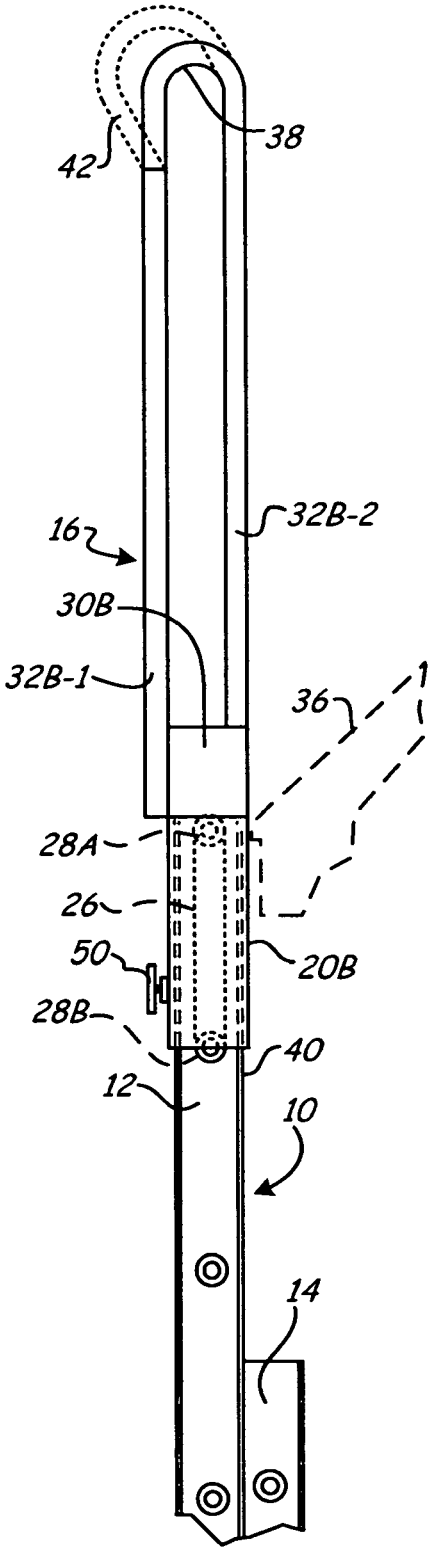
FIG. 1 is a side view of an extension ladder having a walk through extensions made according to the present invention installed thereon.

Referring to FIG. 1, which is a side view, a ladder 10 is shown in a vertical or upright erected position. The ladder 10 is an extension ladder and includes an upper ladder section 12, that is slidably mounted onto a lower ladder section 14, as is common with present day extension ladders.

Figure 3:
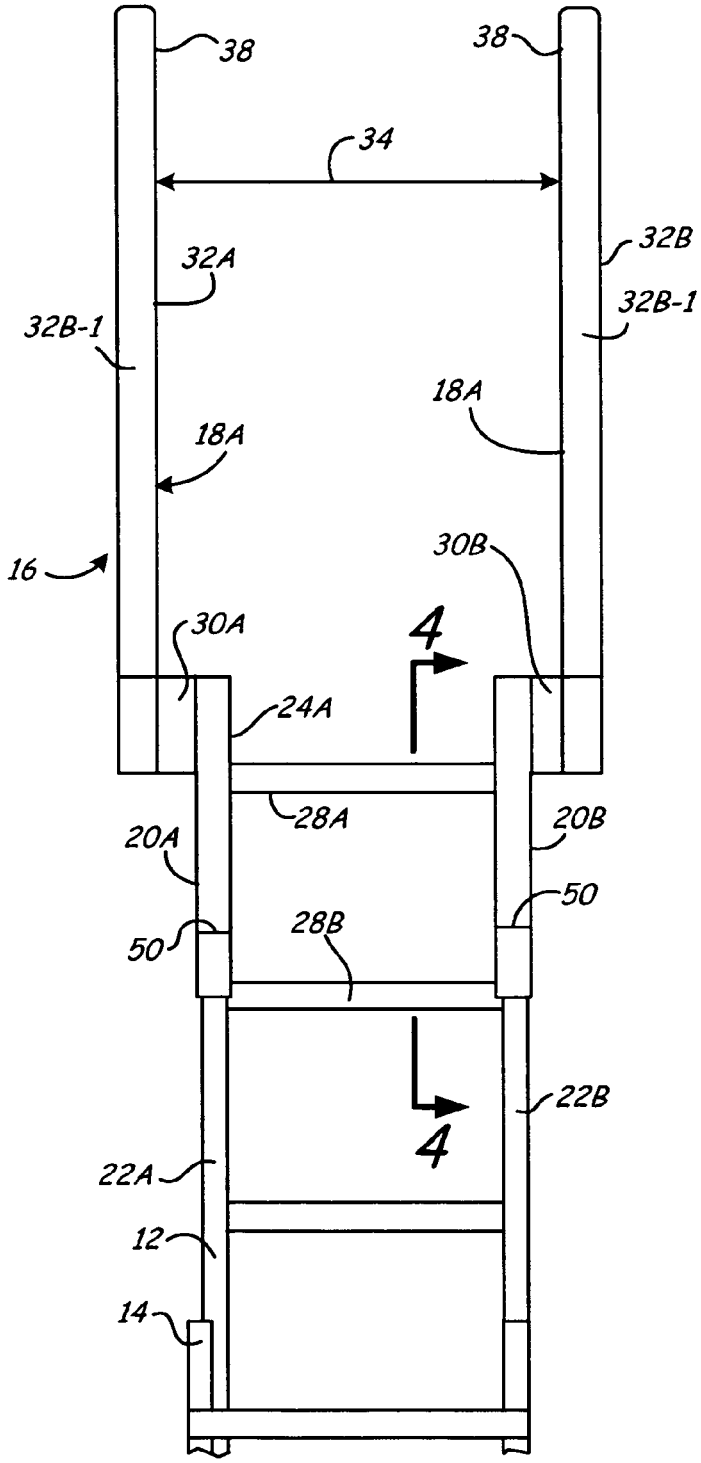
FIG. 3 is a front view of the ladder of FIG. 1.
Figure 4:
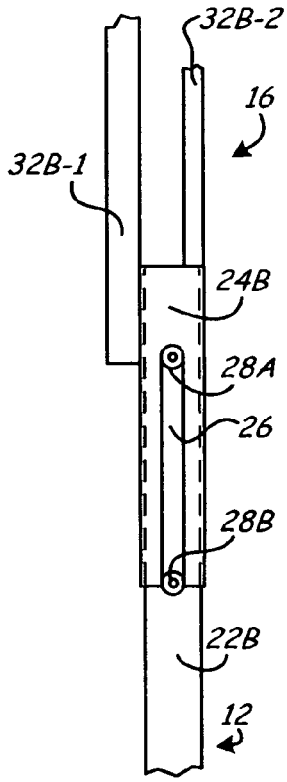
FIG. 4 is a sectional view taken as on line 4-4 in FIG. 3.

A walk through extension assembly 16 made according to the present invention is shown, and as illustrated in FIG. 3, the walk through extension assembly 16 comprises two spaced upright hand rails or supports 18A and 18B. The rails 18A and 18B (FIG. 3) are mirror images of each other, and each of them includes a base comprising a slip on support tube 20A and 20B, respectively, that will slide over ladder side rails 22A and 22B (FIG. 3) of the upper section 12 of the ladder. The slip on support tubes 20A and 20B are shown as rectangular tubes to fit over the ladder side rails 22A and 22B of the ladder 10 shown. The support tube inner walls 24A and 24B, as shown typically in FIG. 4, are provided with open ended elongated slots 26 (only the slot on wall 24A is shown), which are of size to slip over the upper two rungs 28A and 28B of the upper ladder section 12. This means that the slip on support tubes can fit snugly over the side rails.

The slip on support tubes 20A and 20B are snugged up or tightened against the ladder rails to fixedly secure the bases or support tubes 20A and 20B in place, as will be shown. The securing can be done in any suitable manner that can be selected by the user.

The upper ends of the slip on support tubes 22A and 22B are provided with offset spacer sleeves 30A and 30B, respectively, that extend laterally outwardly beyond the ladder side rails 22A and 22B. These spacer sleeves 30A and 30B in turn support upright extension support hand rails 32A and 32B, respectively, which are welded to or otherwise fixed to the spacer sleeves 30A and 30B. The upright hand rails define a space indicated by the double arrow 34 between them. The space between the upright hand rails is wider than the space between the ladder side rails, to provide clearance in this space indicated by the arrow 34 for a person or user to pass through. The upright extension hand rails 32A and 32B are upright members that are of sufficient height to provide adequate stabilization or support for a person that is moving onto a roof, for example. The user can remain erect and step onto a roof while grasping the hand rails. A sloping roof line is illustrated schematically in dotted lines at 36, in FIG. 1.

The upright extension hand rails, as shown, are U-shaped tubes, having an upper curved or formed end 38. The legs of the U-shaped upright extension hand rails are shown at 32A-1, 32B-1. Legs 32B-1 and 32B-2 illustrate that the legs of each upright extension hand rails are spaced apart in fore and aft direction sufficiently to permit a person to grip one of the legs of each upright extension hand rail as the user proceeds moving upwardly on the ladder.

The U-shaped hand rails 32A and 32B are made so that a front or outer side legs 32A-1 and 32B-1 are on the outside of the respective spacer sleeve 30A or 30B, and the rear leg, or the leg toward the building, as indicated at 32B-2, is inside of the sleeve 30A and 30B, respectively, so that the ends of the rear legs do not jut out from the ladder rail flange 40 that is against the building or the edge of the roof 36. This means that if the ladder should sink into the ground, the rails 18A and 18B would slide along the corner of the roof and would not hook or grab.

The top ends of the upright extension hand grip rails can be made into a wider loop, if desired, as shown in dotted lines at 42 in FIG. 1 to provide a larger opening for a hand.

In order to clamp the bases, comprising slip on support tubes 20A or 20B, onto the respective ladder side rail 22A or 22B, a suitable releasable clamping mechanism is provided. In the form shown, a thin sheet or strip indicated at 44 (preferably of metal) is hooked at the upper edge of the respective sleeve 20A or 20B, as indicated by the hook portion 46 in FIG. 2, and is hooked at 48 at the lower end of the sleeve 20B in FIG. 2. The strip 44 is placed on the interior of the slip on support sleeve and can be held in place in other ways, if desired. The ends of such a strip could be riveted to the sleeves or clipped in place.

A suitable nut or other threaded member 48 is fixed to each of the front walls of the respective sleeve 20A and 20B, and a hand wheel that carries a threaded bolt, which is indicated at 50, can be threaded into the nut 48 and passed through an opening in the sleeve so the end of the bolt bears against the metal strip 44 and forces the strip against the flange of the respective side rail 22A or 22B. This will provide a force that will tighten or compress the rear wall of the slip on support tube 20A or 20B against the rear flange of the respective ladder side rail. This provides a secure friction lock to hold the upright hand rails 18A and 18B in place.

Figure 5:
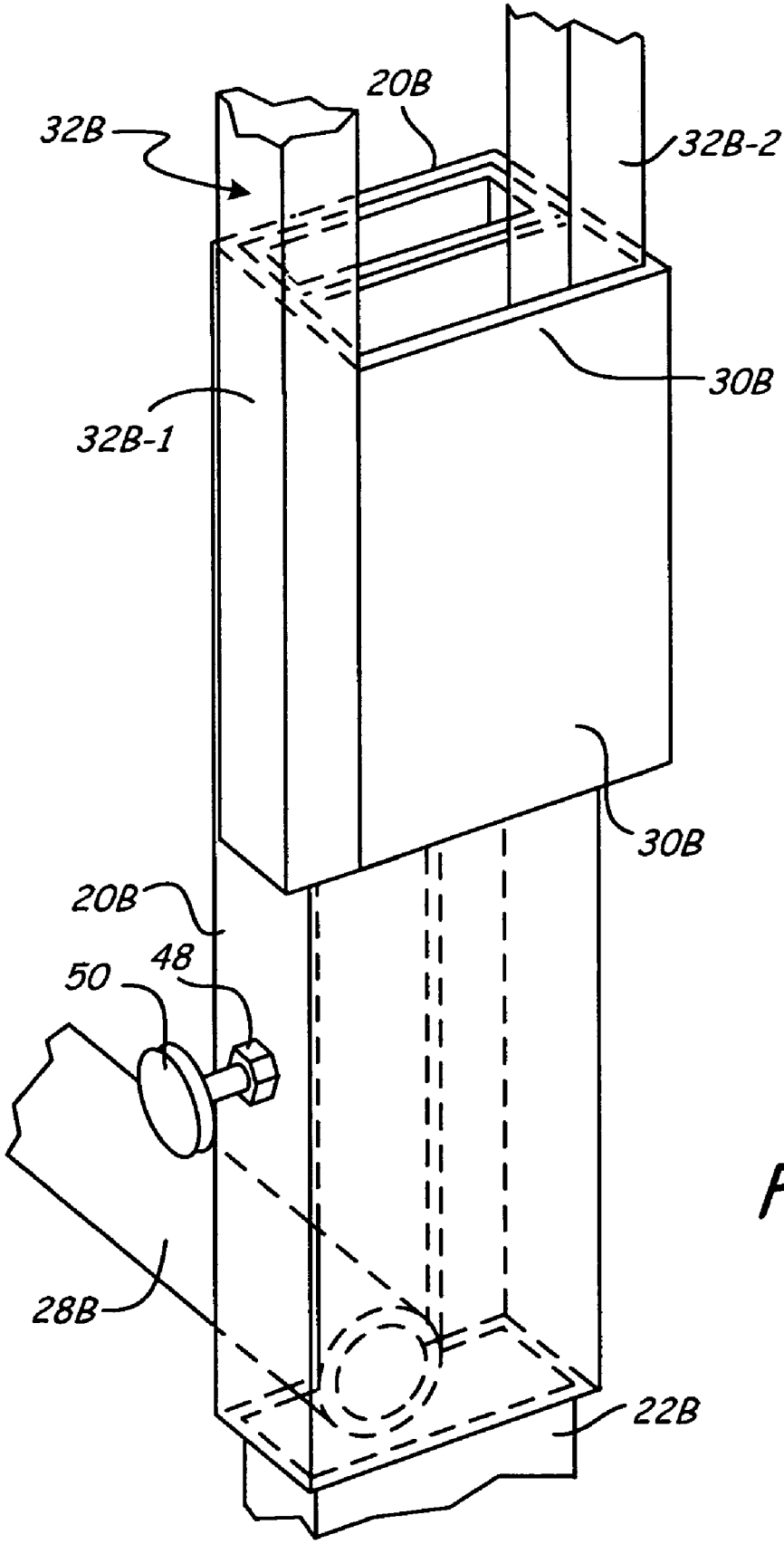
FIG. 5 is a fragmentary perspective view of the support for one of the walk through extensions made according to the present invention.

FIG. 5 shows a perspective view to illustrate the sleeve 30B, and other components used. The rails are shown as square tubes, but they can be cylindrical tubes as will be shown.

Figure 6:
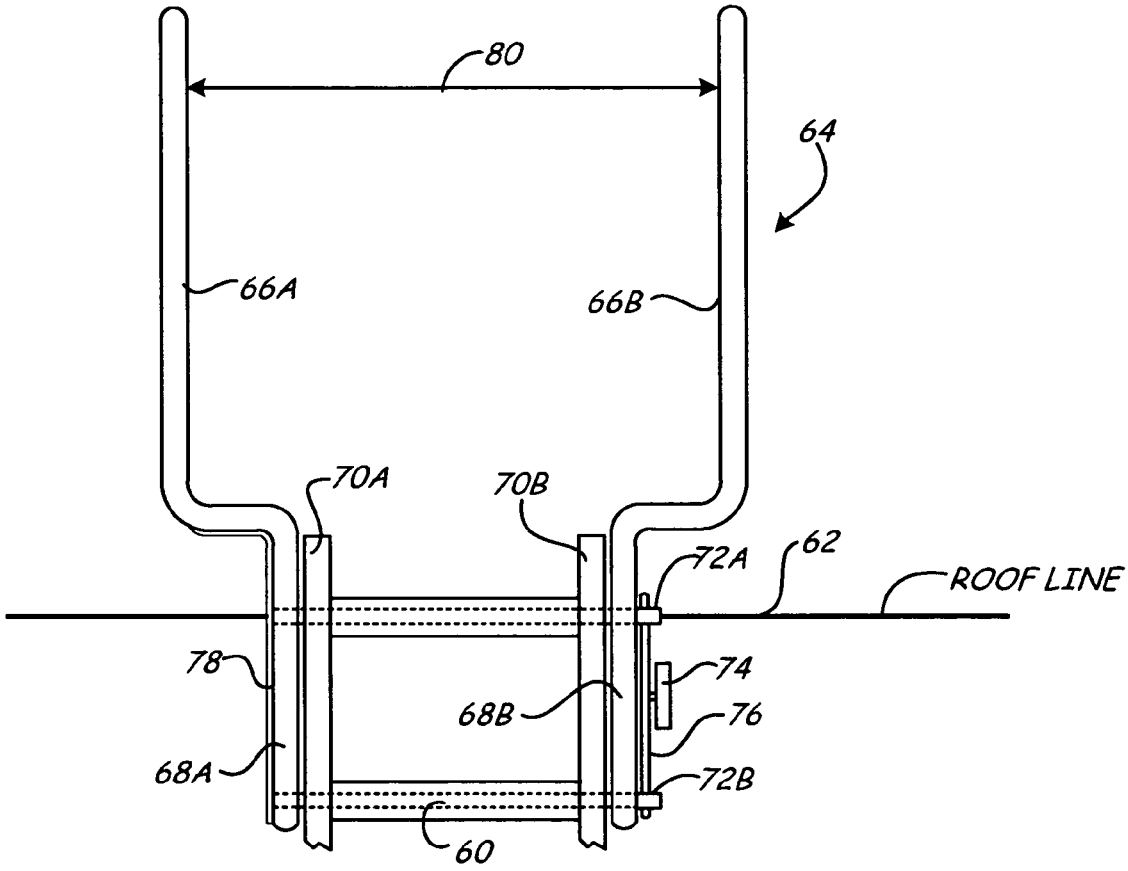
FIG. 6 is a front view of a first modified second form of the present invention.

In FIG. 6, a second modified form of the invention is illustrated schematically, and in this case, the ladder is shown at 60, and it is right at a roof line indicated at 62. The walk through ladder extension assembly 64 in this form of the invention, comprise two upright hand rails 66A and 66B that can be made in a suitable manner. The hand rails have lower inwardly offset support shank sections 68A and 68B that fit against outer sides of the side rails 70A and 70B of the ladder section 68A and 68B. The support shank sections can be held in place with long bolts or shafts 72A and 72B that pass through hollow rungs 61 of the ladder 60. The bolts or shafts are held at the shank section 68A, and the pass through openings in the shank section 68B. The shank sections are secured in place, as shown with a pressure bearing threaded hand screw 74 that is mounted on a strap 76 held on bolts or shafts 72A and 72B, for example, by washers on the ends of the bolts and threading a nut onto the second ends of both of the bolts.

The bolts 72A and 72B are held in place at shank section 68A with a strap assembly 78 on the opposite end from the hand wheel 76. The strap assembly 78 will force the shank section 68A against the rail 70A as the threaded hand wheel 74 is tightened to force shank section 68B against rail 70B. The tightening action will hold the hand rails 66A and 66B in position.

As can be seen, the spread or lateral distance between the hand rail 66A and 66B indicated by the double arrow 80 is also greater than the width of the ladder that is used. The hand rails 66A and 66B can be single tubes or straps, or even channel shaped rails.

Figure 7:
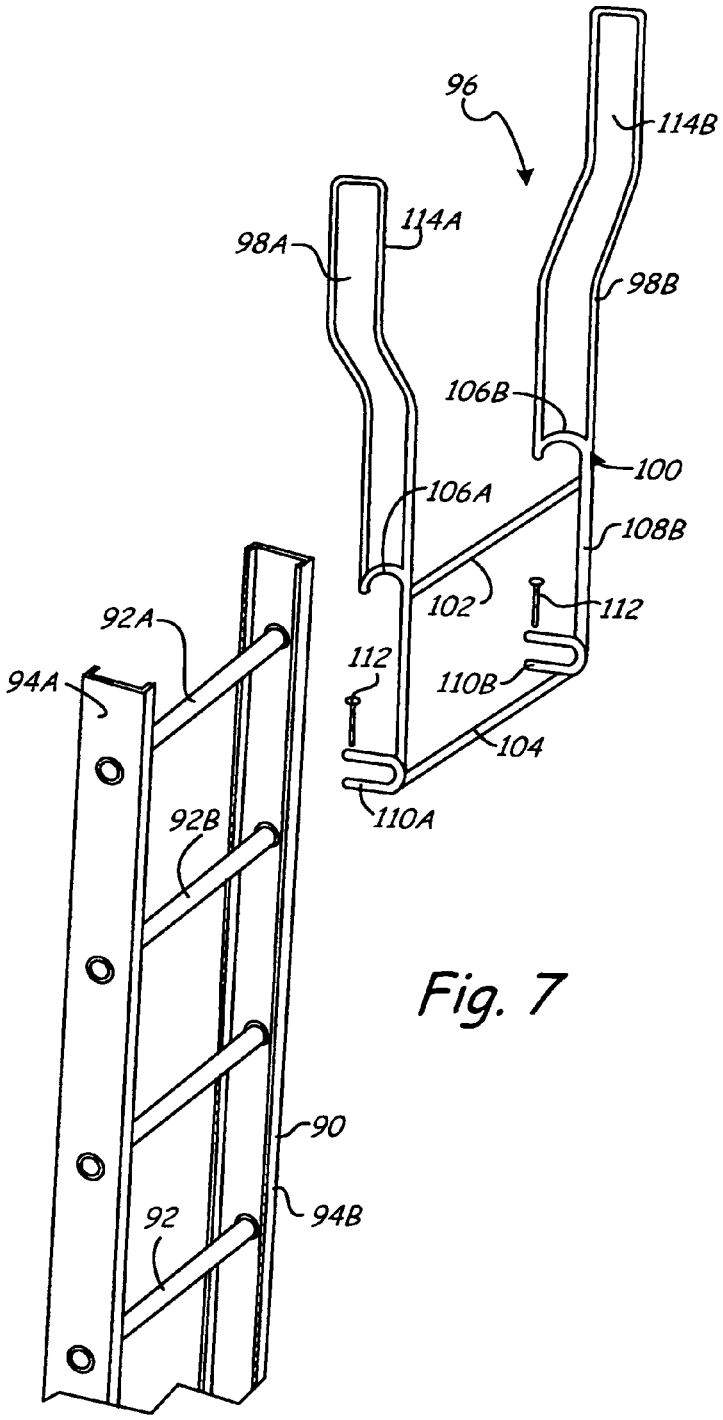
FIG. 7 is an exploded view of a modified third form of the invention showing a walk through rail attachment that will be held on the top two rungs of a ladder.
Figure 8:
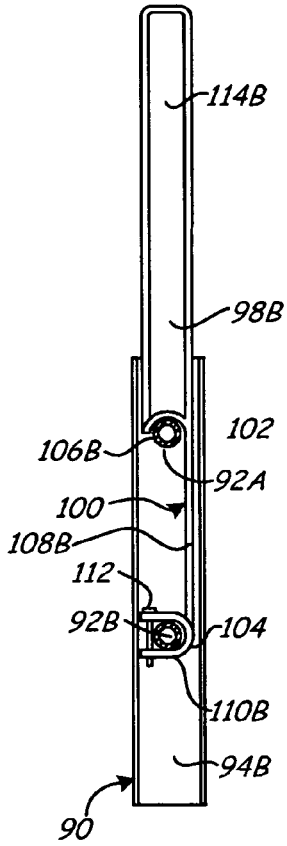
FIG. 8 is a vertical sectional view of the modified third form of the invention showing the walk through attachment mounted on the top two rungs of a ladder.

FIGS. 7 and 8 illustrate a third form of the invention, wherein a ladder 90 is shown schematically, and it has a series of rungs 92 as well as side rails 94A and 94B. A walk through extension hand rail or support assembly indicated at 96 is made to mount on the top two rungs of the ladder, that are illustrated at 92A and 92B, specifically. In FIG. 7, the extension hand rail support assembly is shown spaced from the ladder 90. Two walk through hand rails or upright supports are formed to make the extension assembly. A first hand rail or upright 98A, and a second hand rail or upright 98B are provided. The hand rails have ladder attachment frames or brackets 100 at lower ends, and as shown, the two hand rails or uprights are joined with cross members 102 and 104 to hold the uprights in the assembly.

The ladder attachment frames or brackets 100 have upper hooks 106A and 106B that will fit over the top rung 92A. Struts or supports 108A and 108B of the attachment frames or brackets 100 have clevices 110A and 110B at lower ends that are of size to fit over the second rung 92B, as can be seen in FIG. 8. A suitable latch pin 112 is used in each of the clevices 110A and 110B to hold the hand rail assembly securely in place. When the hooks 106A and 106B are placed on the upper most rung 92A, the clevices can be slipped into place on the second rung 92B. The clevices form releasable latches for the brackets 100.

The upright extension hand rails or supports 98A and 98B, as shown, are offset wider than the ladder rails at their upper portions 114A and 114B to provide adequate clearance for a person to walk through or step between the upright extension hand rails onto a roof or other support structure against which the ladder 90 is placed. The upright extension hand rails extend vertically up from the supports 100 and then taper outwardly with inclined sections 98C and 98D. The inclined sections 98C and 98D join vertical upper portions 114A and 114B.

Figure 9:
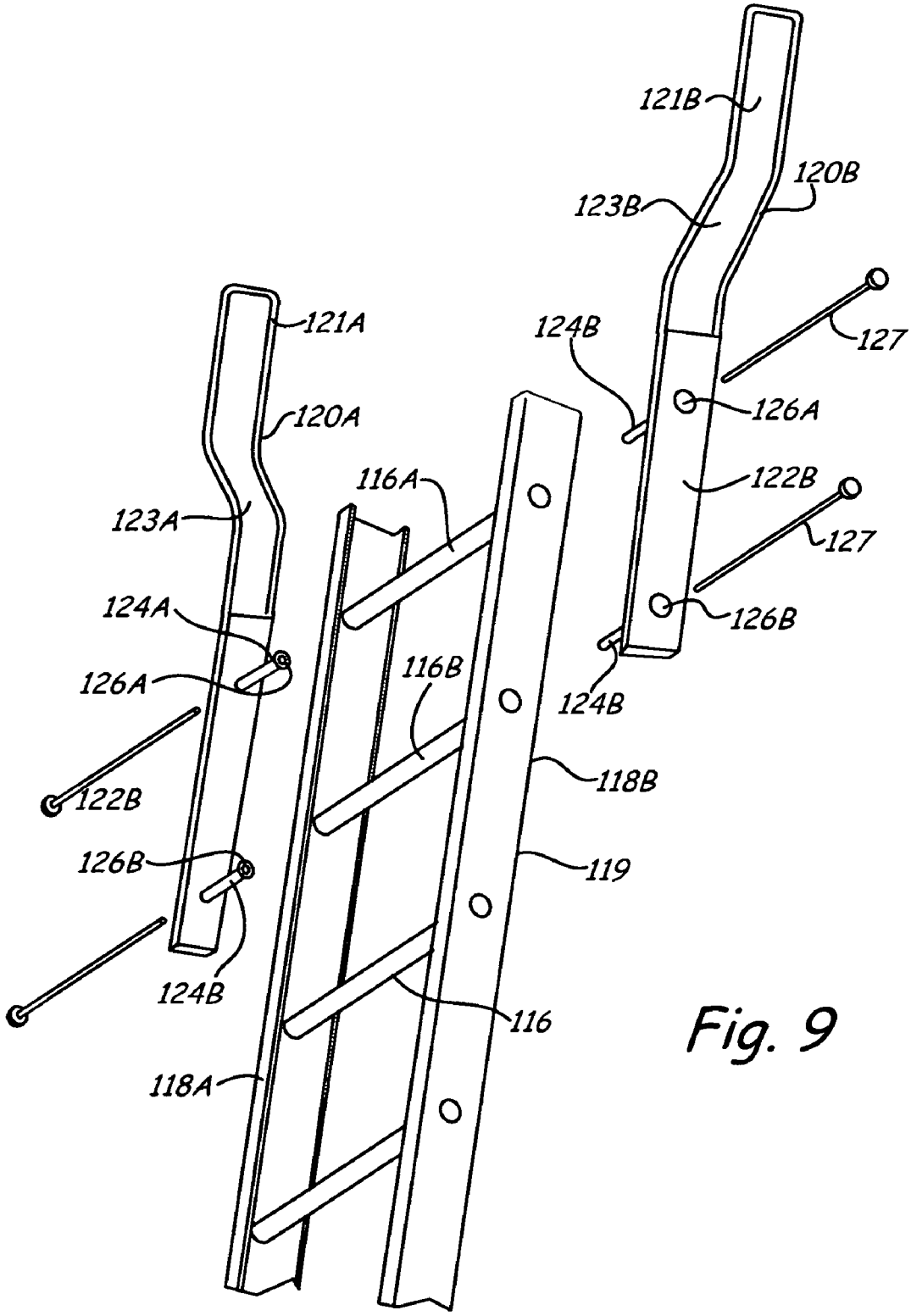
FIG. 9 is an exploded view of a modified fourth form of the invention when used with a hollow rung ladder.

A fourth form of the invention is shown in exploded view in FIG. 9, and in this case, a ladder 119, and has hollow rungs 116A and 116B at least at the top, with the other rungs being shown generally at 116. The ladder 119 also has side rails 118A and 118B that are spaced apart by the hollow rungs 116A and 116B, and other rungs 116.

The upright extension hand rails or supports in this form of the invention are formed into two separate sections. A first upright hand rail 120A, and a second upright hand rail 120B are shown on the opposite sides of the ladder. The walk through upright hand rails 120A and 120B have base portions 122A and 122B that are generally flat straps that will fit inside any ribs or channel walls on the outside of the ladder side rails 118A and 118B. The base portion straps include short tubular nipples 124A and 124B that are welded or fixed to the base portion straps 122A and 122B. These nipples 124A and 124B have bores or apertures shown at 126A and 126B, which will receive long bolts 127, that will pass through the nipples 124A and 124B, and through the hollow rungs 116A and 116B. The bolts then can be clamped tightly on both sides of the ladder. In the illustration, the bolts 127 are shown in two segments, and they can be made so that they have mating threads at their inner ends and are tightened in the center, or the bolts can pass all the way through the ladder rungs and then have nuts so the straps and the guide rails can be clamped in position on the opposite sides.

The upright hand rails 120A and 120B thus are very sturdy and provide a stable guide for walking through the space between them while grasping the hand rails. It can be seen that the upper portions 121A and 121B of the hand rails 120A and 120B, are offset with outwardly angled or tapered offset sections 123A and 123B to provide an adequate opening for a user to walk through while holding onto the upright hand rails for stabilization.

It should be noted that the top end of the hand rails or struts will be in the range of 40 inches above the top rung of the ladder to provide for ease of holding and adequate support as an erect person steps through the space between the hand rails or uprights and onto a roof or other support.

Figure 10:
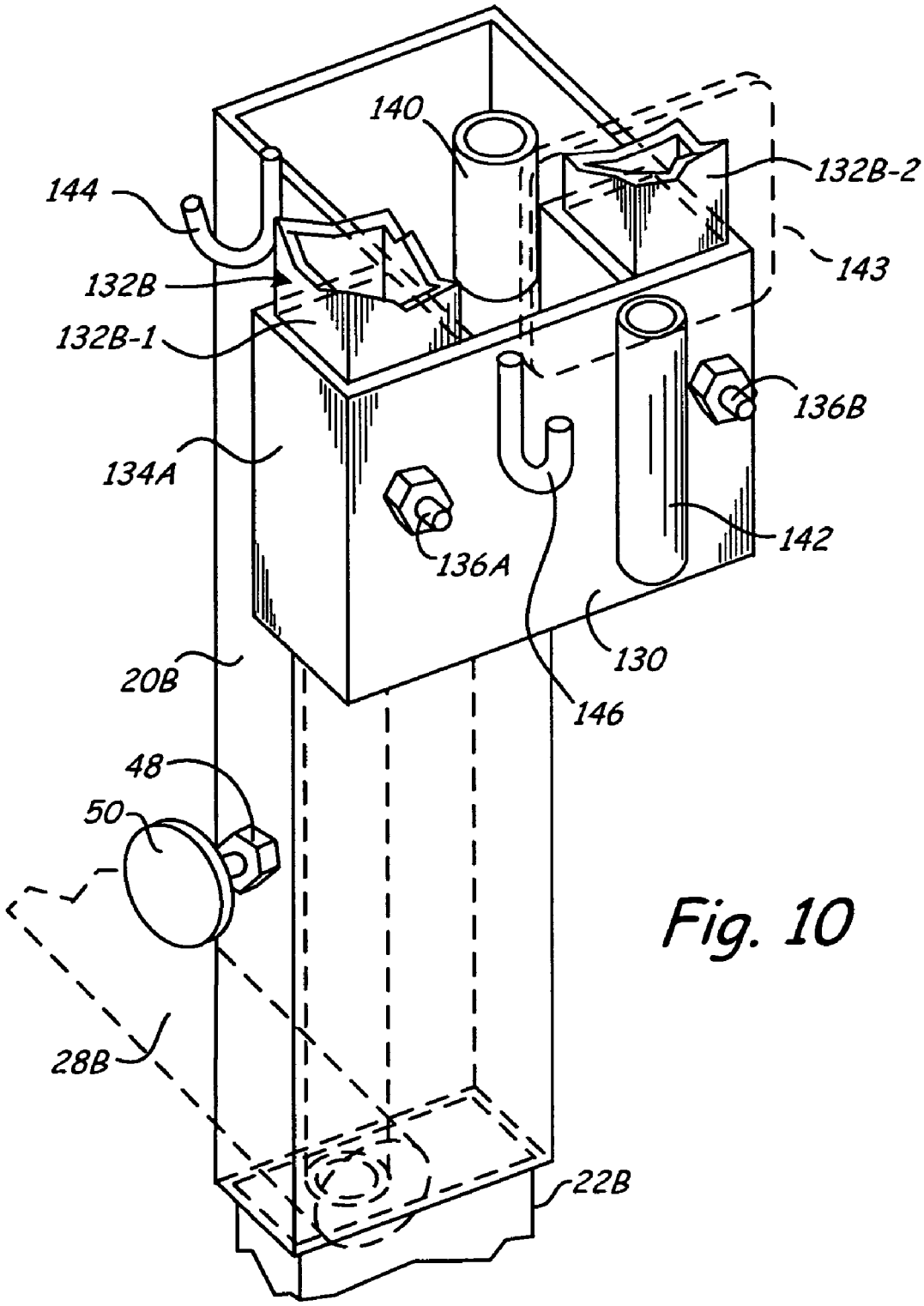
FIG. 10 is a view of the first form of the invention modified to include holders for paint brushes or other tools on brackets that would receive walk through hand rails removable from base sections on the ladder, which base sections can be left on the ladder and used to support accessories.

FIG. 10 is a modified version of the first form of the invention, and in this instance, the ladder is again labeled 22B, and the slip on support sleeve 20B is illustrated. The clamp screw 50 and nut 48 are also shown. The upper offset sleeve portion 130 is modified and made so that the upright extension hand rails 132B, including the individual support members 132B-1 and 132B-2 are slidably placed in sockets 134A and 134B that are formed on the sleeve 130. These sockets will receive the ends of the uprights 132B-1 and 132B-2, and the uprights can be fastened or held in place with suitable bolts passing through the walls of the sockets. These bolts are shown at 136A and 136B. Securing devices other than bolts can be provided for holding the upright hand rails, or the upright hand rails can merely slip into the sockets if they are stable and secure.

In this form of the invention, the offset sleeve 130 is provided with receptacles and holders for holding accessories that would be used on a ladder, including tools such as hammers, or paint brushes, paint cans and the like. A tube 140 is illustrated on the interior of the offset bracket 130, and has an opening of size to receive the handle of a paint brush, for example. Likewise, a tube 142 is on the outside of the sleeve 130, and can be of size to receive a hammer handle, a wrench, or other tool as well as the handle of a paint brush or paint pad. A paint brush is shown in dotted lines at 143 for illustrative purposes.

A hook 144 is fixed on one wall of the slip on support sleeve 20B, and can be used for hanging a paint can, as can the hook 146 which is fixed on the offset sleeve 130. In this form, the walk through upright extension hand rails 132 can be removed by removing the bolts 136A and 136B, and the slip on support tubes or bases 20A and 20B can be left in place on the ladder side rails. Then, when the ladder is used for other tasks, such as painting, repair or the like, the holders shown are usable. The accessory holders will be available with or without having the walk through upright hand rails in place.

Figure 11:
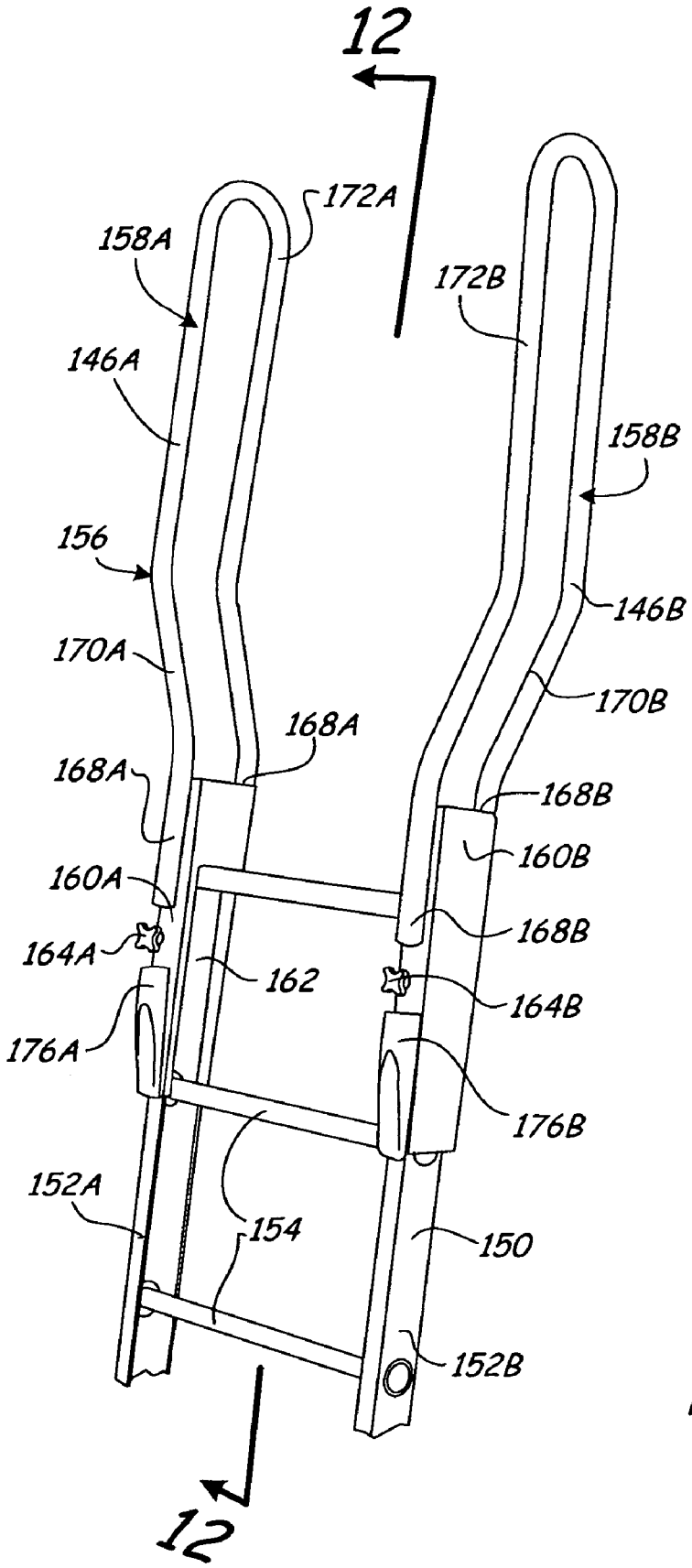
FIG. 11 is a perspective view of a further embodiment of the invention.
Figure 12:
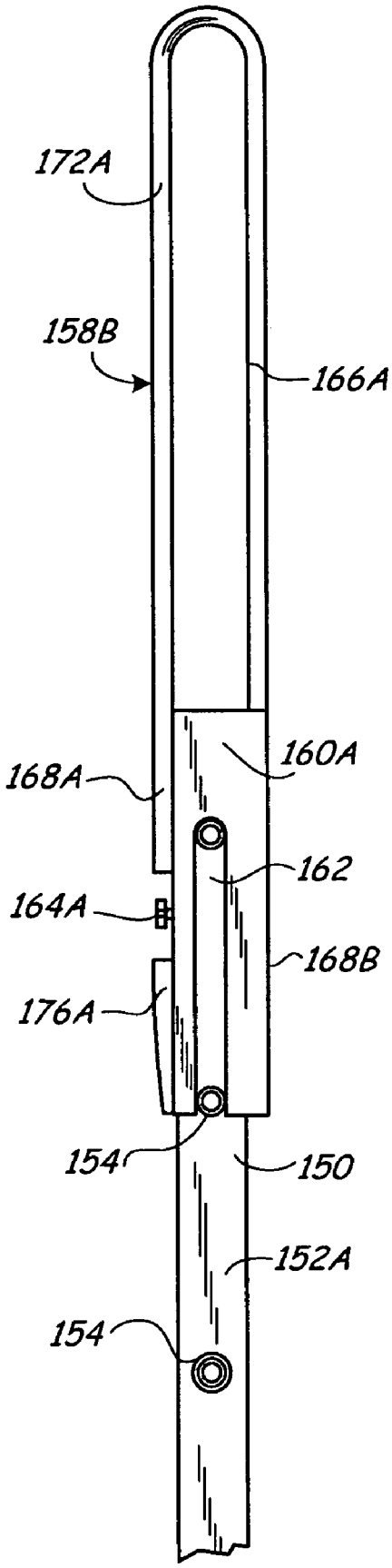
FIG. 12 is a sectional view taken on line 12-12 in FIG. 11.
Figure 13:
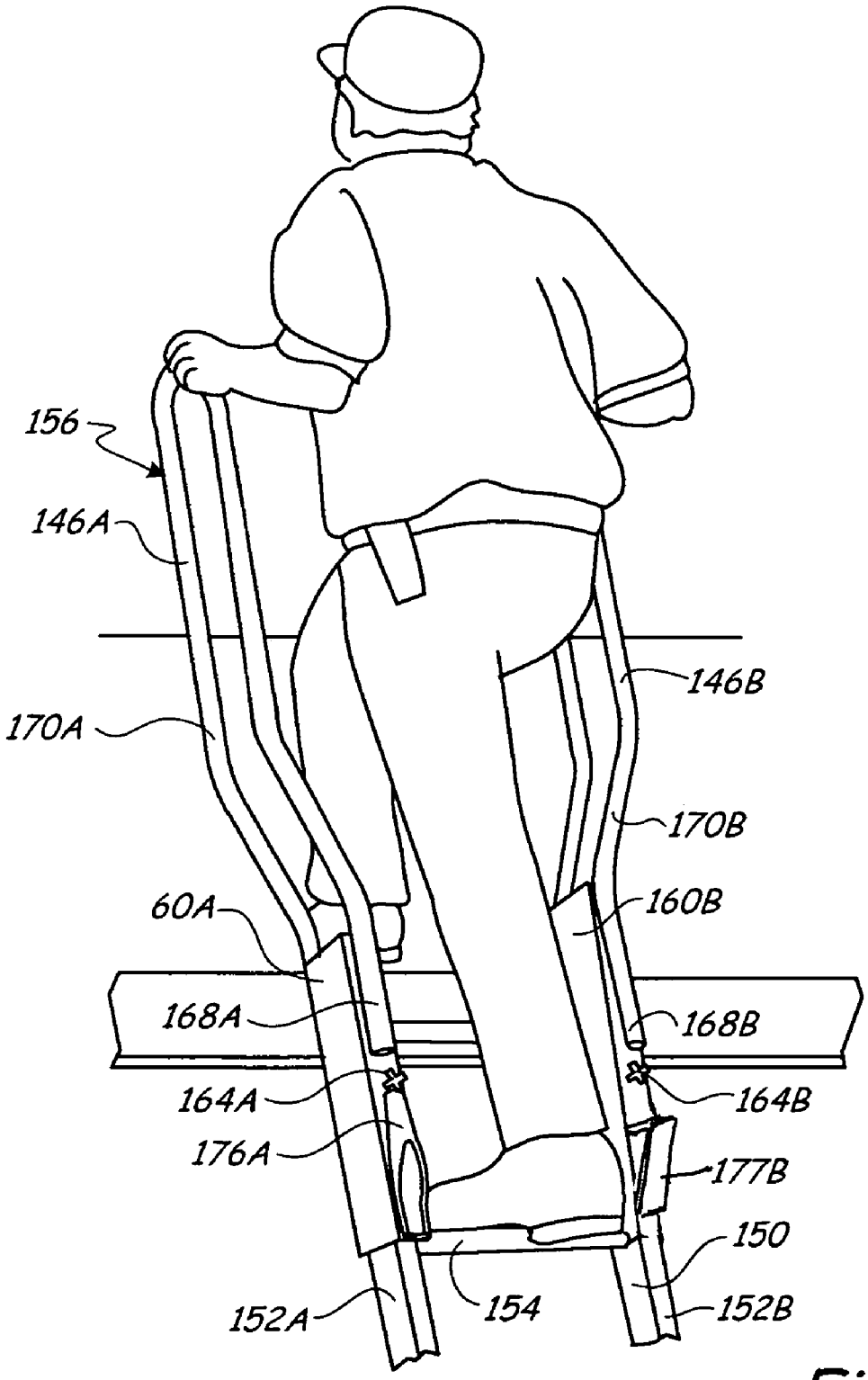
FIG. 13 is a schematic showing of a person using the support extension rails.

FIGS. 11, 12 and 13 illustrate a further modified form of the invention which incorporates the features shown in FIG. 1, but shows cylindrical tubing used for forming the upright rails.

Figure 2:
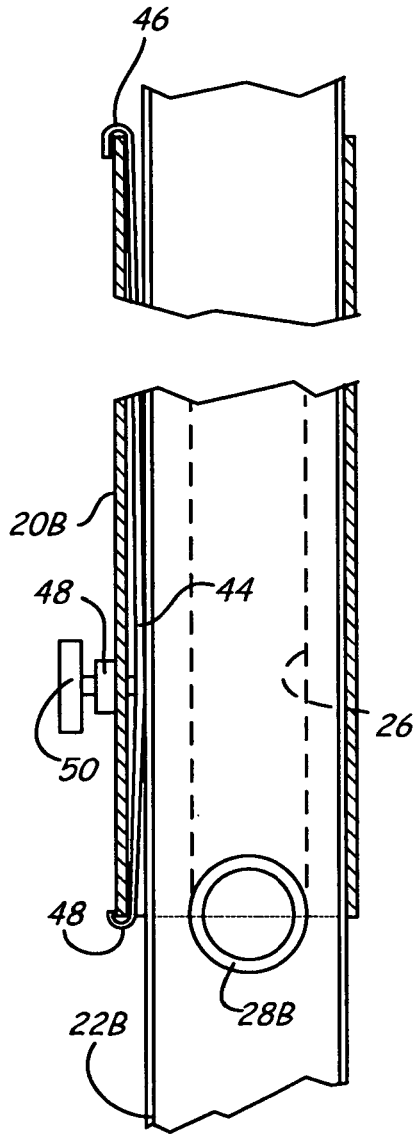
FIG. 2 is an enlarged view of a mounting arrangement for holding the walk through extensions on to the upper end of a ladder, with parts in section and parts broken away.

A ladder shown at 150 has side rails 152A and 153B with rungs 154 extending between the side rails. A walk through upright extension assembly 156 comprises two spaced apart upright extension hand rails 158A and 158B. These hand rails have base sections or supports 160A and 160B, which are the slip on tubes that slip over the side rails 152A and 152B. The slip on tubes have long slots, one of which is shown at 162 for the side rail 158A, and slide over the top two rungs 154 of the ladder 150. Slip on tubes 160A and 160B are held in place with threaded hand wheels 164A and 164B, which can act directly against the side rails of the ladder, or can act against a lock strip as shown in FIG. 2. In any event, the hand wheels 164A and 164B are used for holding the bases or slip on supports 160A and 160B in place on the ladder side rails.

The upright U-shaped tubular members 166A and 166B are formed so that they will have lower portions 168A and 168B that are secured to the slip on tubes 160A and 160B. At the front or outer surface of the base sections or supports, the lower sections 168A and 168B end above the hand wheels 160A and 160B. On the backside or inner side, the lower portions of the legs of the U-shaped extension hand rails are fixed to the top of the slip on tubes, and flush with the rear surface of the slip on tubes so they form smooth continuations of the rear surfaces.

The uprights 166A and 166B include laterally outwardly extending sections 170A and 170B that extend laterally out from the slip on supports 160A and 160B, and the lower portions 168A and 168B, to provide for a wider space between upper portions 172A and 172B of the upright extension hand rails. Thus, it can be seen that in this form the upright extension hand rails 158A and 158B are smoothly formed, and have rounded upper ends that are easy to grip, and yet the upper portions are spaced apart to permit a person to walk through as shown in FIG. 13. The laterally outwardly extending sections do not have to be tapered, but can be horizontal sections joined to the lower portions 168A and 168B by a 90° bend to provide the horizontal offset, and the horizontal sections joined to the upper portions by a second 90° bend. The offset portions can be reinforced by doubling the tubes for that section.

At the lower portions of the front side of the slip on support tubes 160A and 160B outwardly and upwardly tapered guides and hand wheel protectors are provided. As shown, there are tapered end sections of tubing 176A and 176B. The protector guides can be flat straps that are tapered out from the front surface of the support tubes, and then supported back to the front surfaces. This modified form is shown schematically on bracket 160B in FIG. 13 at 177B. The protector guides 176A and 176B have gently tapered lower end sections that will act as guides so that clothing and tools will be guided past the hand wheels 164A and 164B as a user moves up to mount the ladder and walks through the rails 158A and 153B. Also, the protector guides extend out far enough so if the ladder is dropped, they will protect the hand wheels from damage.

The tubing that is used for the upright hand rails 166A and 166B is easily formed into the gently tapered section 120A and 120B configuration to widen out the upper portions 172A and 172B sufficiently to permit a user, as shown in FIG. 13, to hold onto the upright portions of the railings for stability, and for walking through the supports, while erect, to reduce the awkward movements needed when exiting or moving from the upper end of an upright ladder. The same type of support from the upright hand rails is available when the user is entering the ladder to descend from the roof or other support structure.

The upright hand rails are elongated a sufficient amount for use by tall or shorter people.

Another feature of the system shown is that the hand rails can be attached to a ladder and removed without using any special tools.

Although the present invention has been described with reference to preferred embodiments, workers skilled in the art will recognize that changes may be made in form and detail without departing from the spirit and scope of the invention.

What is claimed is:

1. A walk through side extension kit for a ladder having ladder side rails with longitudinal axes, comprising at least one elongated hand rail, and a bracket for supporting the at least one hand rail at upper ends of one of the side rails of a ladder, said bracket comprising a support tube having front and rear walls and being of size to slide over upper portions of the ladder side rail, and wherein the support tube front and rear walls face front and rear walls of the ladder side rail on which the bracket is to be mounted, the at least one hand rail comprising a tube formed into a U-shape and having a base portion of spaced apart front and rear legs mounted to the front and rear walls, respectively, of the support tube along a length direction of the support tube and extending along the support tube substantially parallel with the longitudinal axis of the one ladder side rail and the hand rail having an upper end portion projecting above the ladder and spaced laterally outwardly from the one ladder side rail when installed thereon, and an outwardly tapered and upwardly extending portion between the base portion and the upper end portion of the hand rail to support the upper end portion.

2. The kit of claim 1, wherein the outwardly tapered and upwardly extending portion is formed with the base portion and upper end portion as a unit, and extending upwardly as well as laterally outwardly at an angle relative to the base portion.

3. The kit of claim 1, wherein the kit comprises a pair of hand rails and a pair of brackets, each bracket for mounting one hand rail on a separate ladder side rail of the same ladder, of the ladder, and latches on each bracket for engaging a second rung of the ladder below the first upper rung.

4. A walk through side extension kit for a ladder having spaced ladder side rails with longitudinal axes and ladder rungs supported on and extending between the ladder side rails, comprising a pair of elongated hand rails, and a pair of brackets for supporting the hand rails at upper ends of the side rails of a ladder, respectively, the hand rails each having a base portion mounted to the respective bracket and extending substantially parallel with the longitudinal axis of the respective ladder side rail, and each hand rail having an upper end portion projecting above the ladder and spaced laterally outwardly from the respective ladder side rail when installed thereon, and each hand rail having an outwardly extending portion between the base portion and the upper end portion to support the upper end portion, wherein said brackets comprise support tubes that slide over upper portions of the ladder side rails, and wherein the support tubes each have one wall that faces a wall of the ladder side rail on which it is to be mounted, a threadable hand wheel on an exterior of said one wall of each of the support tubes and threadable through the respective support tube to provide a force against a surface of a wall of the respective ladder side rail, said hand wheels protruding from the support tube, and a tapered guide below each of the hand wheels for guiding objects to slide past the hand wheels when the objects are moved in direction along the support tubes.

5. The kit of claim 4, wherein the one wall of the respective support tube is facing a surface of a ladder side rail that faces a user of a ladder as the user of such ladder climbs upwardly, the hand rails each comprising a tube formed into an inverted U-shape, the base portion comprising a pair of spaced apart co-planar legs, with one leg secured to the one wall of the respective support tube and a second leg secured to a wall of the respective support tube opposite from the one wall, the outwardly extending portion of each hand rail being formed as a unit with the pair of legs and the upper end portion.

6. A hand rail for use with a ladder having ladder slide rails joined by ladder rungs between the ladder side rails, the hand rail comprising a mounting sleeve having a generally rectangular cross section with front and rear walls and first and second side walls, the first side wall having a slot therein extending from a lower end of the sleeve and the length to slide over rungs of a ladder, a ladder rail extension comprising a generally U-shaped tube forming first and second legs that are spaced apart, the U-shaped tube having base portions secured to the front and rear walls of the sleeve, respectively, and having an intermediate section formed as a unit with the base section and inclined laterally outwardly from a second side wall of the sleeve, and also extending in a direction away from the sleeve, and the U-shaped tube having an upper portion with the legs of the U-shaped tube forming the upper portion being on a plane generally parallel to the second side wall of the sleeve, and extending upwardly from the intermediate portion, the sleeve being of size to slip over a side rail of a ladder, a hand screw threadably mounted through the front wall of the sleeve and extending into an interior opening of the sleeve, and a tapered guide between the hand screw and an end of the sleeve opposite from the upper portion, said tapered guide tapering outwardly away from front the wall in a direction toward the hand screw and extending outwardly from the front wall at least substantially equal to the amount the hand screw extends from the front wall in a working position.

7. The hand rail of claim 6 wherein said base portion, said intermediate portion, and said upper portion of said U-shaped tube are formed as a unit from one tube.

* * * * *